US007063345B2

(12) United States Patent
Holzer

(10) Patent No.: US 7,063,345 B2
(45) Date of Patent: Jun. 20, 2006

(54) SAFETY SKI BINDING INCORPORATING A TOE AND A HEEL BINDING AND AN ELECTRONIC CIRCUIT ARRANGEMENT

(75) Inventor: Helmut Holzer, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 95 days.

(21) Appl. No.: 10/760,001

(22) Filed: Jan. 16, 2004

(65) Prior Publication Data

US 2004/0145153 A1 Jul. 29, 2004

(30) Foreign Application Priority Data

Jan. 29, 2003 (AT) ..... A 134/2003

(51) Int. Cl.
*A63C 9/08* (2006.01)

(52) U.S. Cl. ..... 280/611; 280/613; 280/617; 280/618; 280/816; 280/809

(58) Field of Classification Search ..... 280/617, 280/613, 618, 816, 809
See application file for complete search history.

(56) References Cited

U.S. PATENT DOCUMENTS 4,851,706 A 7/1989 D'Antonio
6,007,086 A * 12/1999 Hopkins ..... 280/612

FOREIGN PATENT DOCUMENTS

| | | |
|---|---|---|
| AT | 404 901 | 3/1999 |
| DE | 33 43 047 | 6/1984 |
| DE | 43 30 302 | 3/1994 |
| DE | 44 46 260 | 8/1995 |
| EP | 0 469 453 | 2/1992 |
| EP | 0 580 021 | 1/1994 |
| EP | 1 273 324 | 7/2001 |
| FR | 2 823 986 | 10/2002 |

* cited by examiner

*Primary Examiner*—Christopher P. Ellis
*Assistant Examiner*—Cynthia F. Collado
(74) *Attorney, Agent, or Firm*—Collard & Roe, P.C.

(57) ABSTRACT

The invention relates to a safety ski binding (1) with a toe and a heel binding (4, 5) and an electronic circuit arrangement (6). This circuit arrangement (6) comprises a computer unit and a memory system as well as a sensor system (8) for detecting at least one set safety release value of the safety ski binding (1). The circuit arrangement (6) has at least one electronic evaluation device (13, 14) with a software-driven, programmable micro-controller (39, 40), the micro-controller (39, 40) having a non-volatile memory system (41, 42) or being connected to a non-volatile memory system (41, 42). This micro-controller (39, 40) is programmed to store manually altered settings of the safety release value and/or changing states of the safety ski binding (1) detected by the sensor system (8) in the memory system (41, 42).

14 Claims, 3 Drawing Sheets

SAFETY SKI BINDING INCORPORATING A TOE AND A HEEL BINDING AND AN ELECTRONIC CIRCUIT ARRANGEMENT

BACKGROUND OF THE INVENTION

1. Field of the Invention

The invention relates to a safety ski binding incorporating a toe and a heel binding and an electronic circuit arrangement, with a computer unit and a memory system as well as a sensor system detecting at least one a set safety release value for the safety binding.

2. The Prior Art

Patent specification EP 0 469 453 A1 discloses a safety ski binding with an electronic device for displaying the set safety release force. A display is provided, which displays the values of settings detected and determined by a sensor and an electronic evaluation device. A power supply in the form of a battery is also provided, so that the electrical components can be supplied with power by activating and deactivating a switch. The sensor, by means of which the set safety release value, is detected is provided in the form of a position sensor, which delivers a characteristic electric sensor signal depending on the position of an adjusting screw for setting the safety release value. It is proposed that a capacitive sensor, an inductive sensor or a plurality of micro-switches should be used for the sensor. Another suggestion is that a potentiometer and an adjustable resistor be used for electronically detecting the respective position of the adjusting screw. The disadvantage of this system is that an analogue signal evaluation of the virtually static or absolute position sensors is necessary, which means that the electronic components have a high sensitivity to interference and a low output range. Although the currently set safety release value can be electronically detected and shown on a display with this system, it is not possible to detect changes in the safety release value.

An electronic display device for indicating the set release force of a safety ski binding is known from patent specification DE 33 43 047 A1. In this case, the spring-biassing action of the releasing mechanism is detected by an electromechanical transformer, which converts the prevailing spring biassing force into electrical information. An electronic circuit converts this information into digital format so that it can be presented on a digital display system. A potentiometer is also proposed, which measures any variation of the adjusting screw relative to the binding housing. Here again, there is no provision for displaying the respective safety setting.

Patent specification AT 404 901 B discloses a ski binding referred to as a coupling mechanism with an electronic display device and a sensor system, by means of which the relative position of the ski binding with respect to the ski or the distance between the toe and heel binding can be detected and displayed. Travel or force measurement transmitters are also proposed, by means of which the releasing force set for the ski binding is measured and transmitted via wires to the evaluation device, thereby enabling the position values to be shown in the form of a digital presentation on the display. In order to make it easier to adapt the safety release value as necessary in the event of changes in the binding distance, the respective binding distances can be detected by sensors and this binding distance incorporated in a recalculation of the requisite safety release value. In particular, an electronic computer unit in the ski binding assists with setting the requisite safety release value, which depends on various different parameters, such as body weight, skiing ability and sole length or binding distance, for example. Furthermore, measurement values or status variables of the ski binding can be detected and monitored by means of various sensor systems. For example, the release and any changes to which it is susceptible during active operation of the coupling mechanism is continuously monitored by measurement transmitters and evaluated in the computer unit if necessary or merely stored in a memory element. The purpose of this measurement detection system is to detect the release values for the release mechanism in the toe binding and heel binding so that the force needed to release the release mechanism can be calculated on the basis of such measurement values and controlled if necessary, i.e., the settings can be optimised if necessary. This specification does not mention the idea of logging manual changes to the settings for the safety release values.

SUMMARY OF THE INVENTION

The underlying objective of the present invention is to propose a safety ski binding in which any changes, at least in the settings of the trigger or release mechanisms relevant to safety, can be automatically set and monitored.

This objective is achieved by the invention by means of a safety ski binding, in which the circuit arrangement incorporates at least one electronic evaluation device with a software-driven, programmable micro-controller and the micro-controller has a non-volatile memory system or is connected to a non-volatile memory system, the memory system being programmed to store manually adjustments to settings of the safety release value and/or changing states of the safety ski binding detected by the sensor system.

One of the advantages of the ski binding proposed by the invention is the fact that the safety setting, in particular the so-called Z numbers, are electronically acquired or recorded and stored in the non-volatile memory system for subsequent checking or control. This means, for example, that an authorised control point or optionally the user of the safety ski binding can check at any time to ascertain whether the originally valid or set safety values have been changed. By storing the relevant data in a memory system co-operating with a micro-controller, the electronically detected setting values can be subsequently manipulated, e.g. to record any unauthorised attempt to tamper with what was a correctly set safety ski binding which might otherwise be misleading or confusing, because an unauthorised change made to the settings in the ski binding is recorded. Furthermore, because the memory system co-operates with a micro-controller, the data stored in it is particularly well protected in terms of external unauthorised access or tampering. Accordingly, the safety ski binding has what is in effect an "electronic log book", by means of which authorised persons and optionally the user of the safety ski binding can see any changes and ascertain the current status of the safety sky binding. Another significant advantage of this system is that it provides a means of checking the currently prevailing status and safety settings in the event of product liability claims, in which case the recorded data can be used to get to the bottom of the situation.

In another embodiment of the safety ski binding, both the toe binding and the heel binding have an electronic evaluation device, each incorporating at least one sensor for detecting whatever safety release values have been set, the advantage of which is that both safety-relevant release values of the toe and heel binding can be electronically sensed and recorded and the setting prevailing at the toe binding as well as the setting applied to the heel binding can be stored in at least one electronic or digital memory system in readiness for subsequent checking or control purposes.

In another embodiment of the safety ski binding, the two evaluation devices each have a separate power supply system and transmitter and receiver device to enable wireless, one-way or two-way data or signal transmissions between them, the advantage of which is that the electronic units in the toe and heel binding will be highly reliable for long-term operation, even under inclement weather conditions. In particular, the fact that the signal or data transmission between the mutually independent or autarchical electronic units of the toe and heel bindings operates wirelessly or without contact rules out all risk of operating failure due to poor electrical contacts. It would also be a costly matter to fit the toe and heel bindings with power connections because appropriate precautions would need to be taken, involving insulation in particular, in order to prevent short-circuiting. Wireless signal and data transmission also obviates the need for any sliding contact connections or conductor loops for electrical signal transmissions between parts which move relative to one another, making them susceptible to damage, such as between the ski and its binding plate and the housing of the toe and heel binding. In particular, a wireless high-frequency radio signal transmission can be operated unhampered between the toe binding and heel binding from a whole range of changing positions between the toe and/or heel binding and the ski. More especially, the electronic system of the safety binding unit will not be adversely affected if the relative position of the entire safety ski binding is adjusted relative to the ski or if the binding distance is altered in order to adapt to different shoe sizes. All in all, these factors make for increased operating reliability, even if the safety ski bindings have been mechanically adjusted or reset many times.

In another embodiment of the safety ski binding, the evaluation device incorporated in the toe binding and/or the evaluation device incorporated in the heel binding is conductively connected to a display device, in particular a graphic display, for displaying the settings or status of the safety ski binding, the advantage of which is that an electronic display system will also enable a visual display of the statuses and values of the toe and heel binding to be presented. This offers convenience during use and makes it easier to take a reading of statuses and values relevant to the system. This display device may advantageously also be used as a means of displaying and retrieving log data stored in the memory system as and when necessary.

In another embodiment of the safety ski binding, the evaluation device in the toe binding and/or the evaluation device in the heel binding has an electronic, non-volatile memory system for storing a safety release value as and when it is set, and contains at least one previously valid safety release value, which has the advantage of providing a simple means of recording changes to the safety release values of the toe and heel bindings, even if there is no active signal or data connection between the electronic unit of the toe binding and the electronic unit of the heel binding.

In another advantageous embodiment of the safety ski binding, the evaluation device has an electronic date and/or clock module for logging states or status changes detected by the sensors on the basis of date and/or time, enabling the time, i.e. the date and actual time, of any change of status in the safety ski binding to be automatically recorded, improving tracking and documentation of any changes.

In another possible embodiment of the safety ski binding, the evaluation device has a counter for logging periods of time, for example hours of activation or operating days, the advantage of which is that an automated service or maintenance display can be integrated to ensure that the functionality and operating safety of the safety ski binding can be maintained at a high level for long periods. This also enables early warning to be given of any impending service or maintenance work, for example relating to the electric power supply system. This embodiment may also be used to provide an automated output of service and maintenance recommendations.

Also of advantage is another possible embodiment of the safety ski binding, in which the sensor system has at least one sensor for determining or checking a forward pressure of a slip-on spring system of the heel binding relative to a ski shoe, enabling automatic detection for the forward pressure of the ski binding on a ski shoe inserted therein, which can likewise be logged in the memory system, this being crucial to correct operation of the ski binding. This will expediently alert the user of the safety ski binding if the forward pressure is not correct, enabling him to take whatever steps are necessary, such as cleaning the ski shoe and the ski binding parts or correctly adjusting the slip-on spring system, for example. If the ski binding still does not work, this fact will also be automatically logged in the memory system and these records may then be used subsequently in the investigation of accidents or injuries.

Advantages are also to be had from another embodiment of a safety ski binding, in which the sensor system has at least one sensor for detecting whether the heel binding is in the open and/or closed state, enabling automatic detection of whether the safety ski binding was correctly fastened or is stuck in safety-critical intermediate positions or partially open positions. This state can also be very easily and automatically recorded in the memory system, enabling a reading to be taken for subsequent checking and investigation purposes.

In another embodiment of the safety ski binding, the evaluation device has at least one interface for reading the values and data logged in the non-volatile memory system and/or the transmitter and/or receiver device is programmed to read values and data logged in the memory system, the advantage of which is that data stored in the memory system can be accurately and conclusively evaluated by means of an appropriate external computer or electronic unit. Another advantage is the fact that it enables access to this data to be restricted to a specific number of people or an authorised control point equipped with a reading device of the appropriate type.

In another embodiment of the safety ski binding, the non-volatile memory system is provided in the form of a memory which is stable in terms of its memory contents and without any electric power supply, in particular an EEPROM memory or a flash memory, the advantage of which is that the memory system is largely protected from manipulation by the general public. This also means that the logged values and data will not be erased or altered in the event of a cut in power supply, either intentional or with a view to carrying out maintenance work.

Finally, in another embodiment of the safety ski binding, the transmitter and/or receiver device or the interface and contacts are configured for transmitting data signals to an electronic computer unit and/or for receiving data signals from a peripheral electronic computer unit, in particular a wrist-top computer, a handheld computer, a mobile telephone or any other mobile electronic unit, the advantage of which is that it obviates the need for structurally complex and cost-intensive input means on the electronic ski binding. This specifically means that a stand-alone electronic computer unit is used as the programming and/or operating and/or display means for the electronic system in the safety ski binding. Since nothing or only very simple means are needed for input purposes, there will barely be any problems in terms of external disruptive influences, such as liquids, vibration, mechanical stress and similar. Moreover, this all adds to the functionality, versatility and user convenience, whilst facilitating maintenance work, servicing and adaptation to the electronic system of the safety ski binding.

BRIEF DESCRIPTION OF THE DRAWINGS

The invention will be described in more detail below with reference to the appended drawings illustrating examples of embodiments. Of these.

DETAILED DESCRIPTION OF PREFERRED EMBODIMENTS

Figure 1:
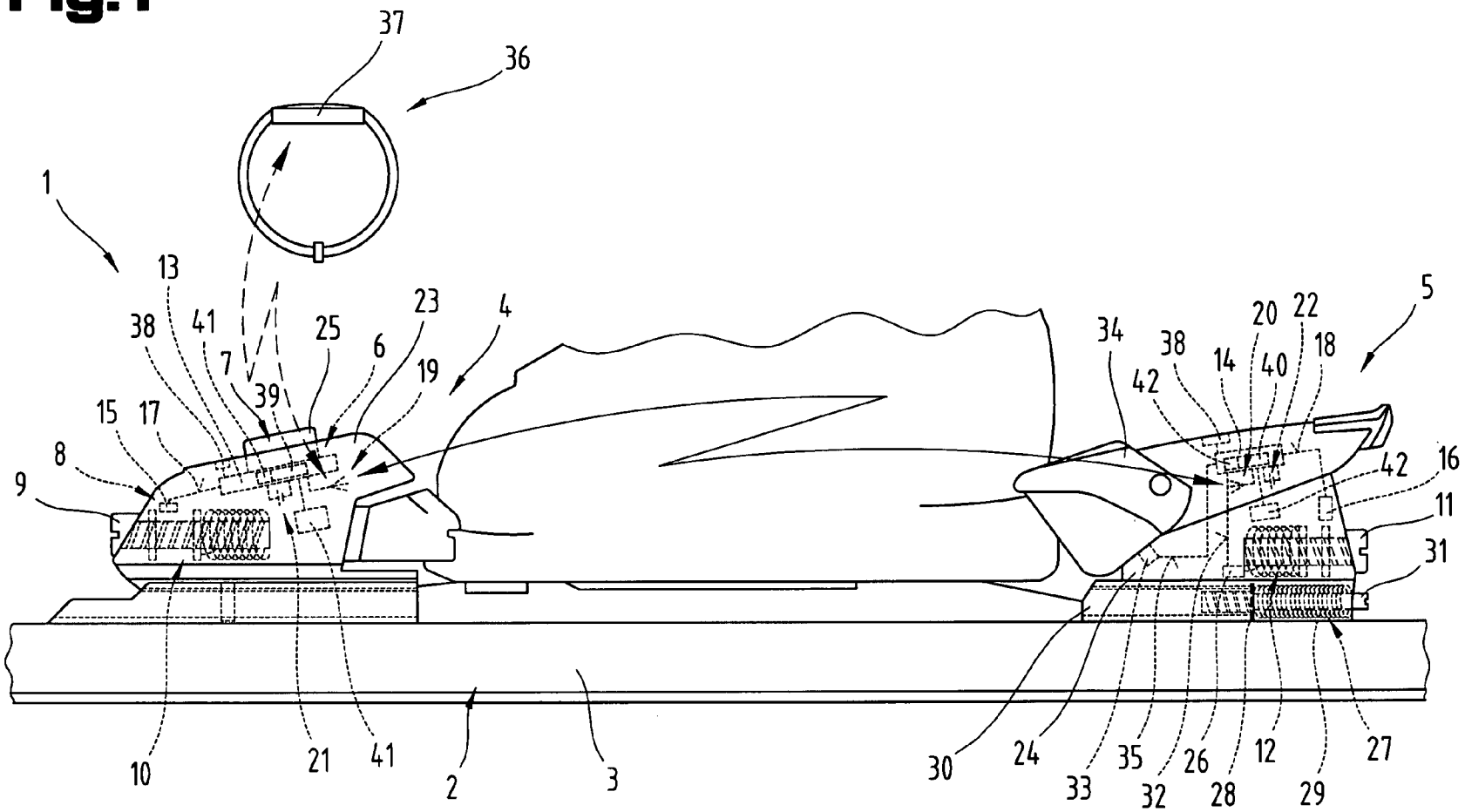
FIG. 1 is a highly simplified, schematic diagram depicting one possible embodiment of a safety ski binding as proposed by the invention in combination with an optional external computer or electronic unit, seen from a side view.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc, relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 is a highly simplified diagram symbolising one possible embodiment of a safety ski binding 1 as proposed by the invention. In a generally known manner, a safety ski binding 1 of this type is used as one of a pair as a means of fastening a sports shoe, in particular a so-called ski boot, to a board type runner device 2, in particular a pair of skis 3.

The safety ski binding 1 essentially consists of a toe binding 4 for retaining the toe region of a sports shoe and a heel binding 5 for retaining the heel region of a sports shoe inserted in the safety ski binding 1. A binding support plate, which is schematically indicated, may optionally also be provided between the front and/or heel binding 4, 5 and the ski 3.

Adjusting and setting mechanisms are also provided on this safety ski binding 1—as schematically indicated—for individually adjusting the position of the toe and/or heel binding 4, 5 relative to one another and/or the unit comprising the toe and heel binding 4, 5 relative to the longitudinal extension of the ski 3. These adjusting and setting mechanisms, which come in a whole variety of types known from the prior art, enable the ski binding 1 to be effortlessly adapted within predefined limits to the respective shoe size or sole length and/or to re-position the points at which forces are transmitted between the ski binding 1 and the ski 3 or binding plate in the longitudinal direction of the ski 3.

The safety ski binding 1 also has an electronic circuit arrangement 6. This circuit arrangement 6 preferably incorporates a display device 7. A sensor system 8 is also provided, to which the circuit arrangement 6 incorporating a computer unit is connected. The circuit arrangement 6 is provided at least as a means of detecting and optionally displaying a set safety release value of the safety ski binding 1. The safety ski binding 1 has—in a generally known manner—a predefined setting range for the safety release value or maximum retaining force on the ski shoe, so that a particular binding type can accommodate a whole range of conditions and users. This safety release value or so-called Z number can be adapted to the individual requirements of the respective user as well as safety requirements by means of an adjusting screw 9 on a release mechanism 10 in the toe binding 4. Likewise, this safety release value or Z number can be varied or set by means of an adjusting screw 11 on a separate release mechanism 12 in the heel binding 5. The purpose of these release mechanisms 10, 11 or variably adjustable release mechanisms in the toe and heel bindings 4, 5 is to effect a controlled release of the sports shoe from the runner device 2—in a manner known per se—in the event of excessive stress likely to incur a risk of injury to the user. The essential point is that because the release mechanisms 10, 12 are independent of one another, there can be no deviation from the settings of the safety release values.

The safety release value set respectively for the toe and heel binding 4, 5 can be viewed on the display device 7. To this end, an electronic evaluation device 13 and 14 of independent construction is provided in both the toe binding 4 and in the heel binding, or evaluation devices 13, 14 are provided which are specifically allocated one to the toe binding 4 and the other to the heel binding 5. The evaluation device 13 co-operating with the toe binding 4 and the evaluation device 14 co-operating with the heel binding 5 and located at a distance apart from it are each provided with at least one sensor 15 respectively 16 for detecting at least the respective setting of the safety release value. In particular, an electrical line connection 17 is provided inside the toe binding 4, between the sensor 15 and the evaluation device 13, and a separate line connection 18 is provided in the heel binding 5 between the sensor 16 and the evaluation device 14. Accordingly, the sensors 15, 16 monitor and detect any change in the release mechanisms 10, 12, in particular any shift or rotation of the adjusting screws 9, 11. By electronically detecting the positional width and positional direction as well as the shift in angular rotation of the adjusting screw 9, 11—which may include several rotations—the respective evaluation device 13, 14 will calculate the currently valid setting of the safety release values, taking account of the setting values that were last valid.

The evaluation device 13 disposed in the toe binding 4 and the evaluation device 14 disposed in the heel binding 5 each have a respective transmitter and/or receiver device 19, 20 for high-frequency, electromagnetic waves or radio signals. The frequency range of the transmitter and/or receiver device 19, 20 is preferably in what is known as the ISM (Industrial Scientifical Medical) frequency range, which extends from the MHz (Megahertz) range to the GHz (Gigahertz) range. In particular, signal and data transmissions are expediently operated in the HF range, for example at 13.56 MHz and 27.125 MHz or in the UHF range of 400 to approximately 950 MHz.

These transmitter and/or receiver devices 19, 20, which may also be designated as HF modules, enable a wireless, one-way or two-way data communication or signal transmission between at least the evaluation device 13 co-operating with the toe binding 4 and the evaluation device 14 co-operating with the heel binding 5. The transmitter and/or receiver devices 19, 20 are also used for wirelessly or contactlessly receiving and/or transmitting high-frequency electromagnetic waves. These transmitter and/or receiver devices 19, 20 specifically enable a one-way or two-way transmission of radio signals, at least between the mutually spaced apart evaluation devices 13, 14 in the toe and heel bindings 4, 5.

To enable operation of the toe binding and heel binding electric components, an electric power supply system 21, respectively 22 is provided for both the toe binding 4 and the heel binding 5. These power supply systems 21, 22 are preferably provided in the form of electrochemical voltage sources, in particular batteries or accumulators, which are preferably mounted in or on the binding bodies. These power supply systems 21 and 22 are respectively connected to an adjacently lying evaluation device 13 or 14 and are preferably accommodated in a housing 23 of the toe binding 4 or in a housing 24 of the heel binding 5.

The design described above advantageously provides a simple means of ensuring that no electrical wire connections are needed between components that move relative to one another. In particular, no flexible wiring or loop contact connection or power-transmitting mechanisms are needed between relatively displaceable elements, such as one of the bindings of the safety ski binding 1 and the runner device 2 or the binding support plate or between the toe and heel bindings 4, 5 which are at least slightly displaceable relative to one another during active operation of the runner device 2. This slight relative displacement between the toe and heel binding 4, 5 and between at least one of these binding bodies and the ski 3 is permitted and controlled by means of a so-called slip-on or longitudinal spring compensating system, which is usually accommodated in the heel binding 5. The electronic units integrated in the toe binding 4 and in the heel binding 5 will therefore be reliable in operation, offering a high degree of protection against operational failure for long periods, and even if used frequently in adverse environmental conditions.

Only one display device 7 is provided on the safety ski binding 1—if one is provided at all—and is preferably disposed on the toe binding or on the heel binding, to display the respective values of the toe binding 4 and the heel binding 5 as well as the respective states of the safety ski binding 1. This display device 7 is likewise connected to the housing 23 of the toe binding 4 or alternatively to the housing 24 of the heel binding 5 so that the display surface is readily visible to the user of the safety ski binding 1. Accordingly, the display device 7 is preferably disposed on the top face of the toe binding 4. The display device 7 together with the co-operating evaluation device 13 may optionally constitute a single unit. Otherwise, a separate line connection may also be run between the display device 7 and its controller and the evaluation device 13. This will be the case in particular if the evaluation device 13 is provided in the region of the bottom face of the toe binding due to restricted space in the binding bodies, for example, and the display device 7 will be arranged in the upper region of the housing 23 of the toe binding 4.

The relevant values or settings of the binding that does not have a display device can therefore be wirelessly transmitted to the binding which does have appropriate display or viewing facilities. Although this should not be construed as restrictive, in a preferred embodiment the values and settings of the heel binding 5 detected by sensors are wirelessly or contactlessly transmitted via the evaluation device 14 or the transmitter and/or receiver device 20 to the transmitter and/or receiver device 19 in the toe binding 4 and displayed on the display device either directly or via the evaluation device 13, with a clear indication as to whether the displayed values relate to the toe binding 4 or the heel binding 5. It should also be possible to present a simultaneous display of values and data for the toe binding 4 and the heel binding 5 on the common display device 7, with indications to make it immediately obvious to the user which values relate to the toe binding 4 and which relate to the heel binding 5.

If the display surface of the display device 7 used jointly by the toe and heel bindings 4, 5 is of a smaller design, the values for the toe and heel binding 4, 5 can be displayed consecutively with a code indicating which is which.

The display device 7 is preferably a display 25 with graphic capability, in particular a LCD display, which enables a plurality of graphic, freely programmable symbols, graphics or texts and numbers to be displayed. It is preferable if a broad range of graphic symbols can be presented on the display 25, by means of which the respective information and messages can be seen by the user as clearly as possible. Displaying graphic symbols on the display 25 obviates the need for at least some word processing tasks, thereby avoiding any problems in terms of presentations as well as problems with regard to different languages, which would otherwise be encountered by different users of the safety ski binding. Controlled by the evaluation device 13 and the evaluation device 14, it is therefore preferable if the display 25 shows only figures or individual letters, for example a "Z" and/or graphic symbols or texts which are universally understandable such as "OK" or "OPEN", for example.

In one advantageous embodiment, the logo or a trade mark of the manufacturer of the safety ski binding or the runner device 2 and/or the type and brand name of the ski binding are indicated on the display 25—controlled by at least one of the evaluation devices 13, 14. Likewise, the display 25, comprising a plurality of image dots or pixels, can be used to present graphic animations.

The evaluation device 14 disposed in the heel binding 5 is preferably also connected to another sensor 26 for detecting a forward pressure of a slip-on spring system 27 of the heel binding 5.

In a known manner, this slip-on spring system 27 ensures that a ski shoe inserted in the safety ski binding 1 is retained between the toe and heel bindings 4, 5 with as little clearance as possible. This slip-on spring system 27 may also be used at least partially to compensate for and absorb angular changes and changes in the spacing between the toe and heel bindings 4, 5 and the ski 3 and binding support plate as the ski 3 bends. Such a slip-on spring system 27 comprises, for example, a thrust bearing 28 fixedly joined to the ski or a thrust bearing fixedly joined to a single-piece or multi-part strip-shaped connecting element between the toe and heel binding 4, 5. Co-operating with this stationary thrust bearing is an elastically flexible element, for example a helical spring 29, which permits limited relative movements between the housing 24 of the heel binding 5 and the ski 3 and with respect to a longitudinal guide 30 for the heel binding 5 permanently joined to the ski. The biassing force of the elastic thrust bearing, in particular the helical spring 29 and hence the characteristics of the slip-on spring system 27, are adjustable via an adjusting screw 31 and/or such an adjusting screw 31 may be used to vary the relative position of the heel binding 5 with respect to the longitudinal guide 30 and with respect to the ski 3 if necessary, in order to accommodate different shoe sizes or make an adjustment to the forward pressure. When the ski shoe is inserted in the safety ski binding 1, the elastic element, in particular the helical spring 29 of the slip-on spring system 27, is biassed, preferably slightly compressed, and the heel binding 5 is moved in the longitudinal guide slightly in the direction towards the ski end so that the ski shoe is inserted without any clearance between the toe and heel binding 4, 5 under the action of the slip-on spring system 27.

Within the context of the invention, it would naturally also be possible to use such a slip-on spring system 27 or a similar compensating mechanism in the toe binding 4 or in the toe and heel binding.

The degree of displacement and the forward pressure exerted by the slip-on spring system 27 relative to an inserted ski shoe is important to correct operation and safety as well as the operating efficiency which can be achieved by the safety ski binding 1. In particular, too low a forward pressure can lead to undesirable relative movements between the safety ski binding 1 and the ski shoe, whilst too high a forward pressure can be detrimental to the performance and bending characteristics of the ski 3 or can have too great an influence on or distort the safety release values set for the toe and heel bindings 4, 5.

The purpose of the sensor 26, therefore, is to control and detect the forward pressure of the slip-on spring system 27 and it records and monitors the relative position of the heel binding 5, in particular its housing 24, relative to a fixed point of the ski, for example relative to the longitudinal guide 30 or relative to a strip-shaped connecting element or relative to a thrust bearing 28 on the ski 3 or the binding support plate.

The sensor 26 of the slip-on spring system 27 may therefore be provided in the form of a pressure or force sensor or alternatively acts as a travel or distance sensor. In particular, the sensor 26 detects the presence of an object to be detected, for example a metal part or a permanent magnet, relative to a sensor surface or its detection range. The characteristic electric sensor signals generated depending on the relative position between the sensor 26 and a detection object stationary on the ski, for example the thrust bearing 28, are transmitted via at least one line connection 32 to the evaluation device 14. The sensor 26 is preferably mounted stationary on the housing 24 of the heel binding 5 so that the line connection 32 between the evaluation device 14 and the sensor 26 can be integrated in such a way that it will function correctly for long periods. If the electronic board of the evaluation device 14 is designed accordingly, it would naturally also be possible for the sensor 26 as well as the sensor for detecting the Z number described above to be mounted directly on the electronic board of the evaluation device 14 without separate line connections 18, 32.

In one advantageous embodiment, the evaluation device 14 provided in the heel binding 5 may also be connected to at least one other sensor 33 for detecting an open and/or closed state of a retaining jaw 34 of the heel binding 5. Like sensors 15, 16, 26 described above, this sensor 33 is also preferably provided in the form of a contactless transmitter or by a contactless detection sensor element. Sensor 33 is likewise connected to the evaluation device 14 in the heel binding 5. Depending on the layout, at least one line connection 35 may be provided between the sensor 33 and the evaluation device 14, as indicated by broken lines. Depending on the position of the retaining jaw 34, i.e. depending on whether the heel binding 5 is open or closed, different associated characteristic sensor signals are transmitted or supplied by at least one sensor 33. These various typical sensor signals are evaluated by the evaluation device 14 and a status of the sensor properties determined, enabling a conclusion to be drawn in respect of the prevailing coupling states of the ski binding 1 and the heel binding 5.

The sensor 33 primarily applies a control to ensure that the heel binding 5 is closed correctly. In particular, if the retaining jaw 34 is open or only partially closed, which might be the case if too much ice and/or snow has accumulated on the ski shoe for example, a message or a warning message, e.g. "Open", or a corresponding warning signal is indicated on the display device 7. This prevents premature or faulty release of the heel binding 5, which might otherwise be caused if the retaining jaw 34 were not fully in the closed position, because the user of the safety ski binding 1 would be alerted to the fact that something was not right. This improves the safety of the user of the safety ski binding 1 embarking on skiing sports as well as other persons who happen to be near him.

At least the detected values and/or the respective states of the heel binding 5 detected at any one time by the sensors are transmitted from the toe binding evaluation device 14 by the transmitter and/or receiver device 20 via a wireless data transmission route on the basis of high-frequency signals and can therefore be received by the transmitter and/receiver device 19 of the other coupling part, in particular the toe binding 4, and presented in an appropriate format on the display device 7 if necessary. Alternatively or in combination, the signals and data arriving at the evaluation device 13 may be further processed or memorised.

The transmitter and/or receiver device 19 and/or 20 may also be used to for a signal and data transmission to an external component, in particular an external, stand-alone electronic unit 36. This structurally separate electronic unit 36 might be a wrist-top computer 37, as schematically indicated, in other words a multi-purpose wrist watch, a personal data assistant (PDA), a stationary control device or any other mobile computer unit. Various states and setting values of the safety ski binding 1 can also be displayed on this electronic unit 36, if necessary, and the electronic unit 36 may be used to edit various settings and operating configurations, in which case this electronic unit 36 may optionally be used as a programming or maintenance device for the electronic system of the binding or circuit arrangement 6. Communication between the circuit arrangement 6 and the mobile electronic unit 36 is therefore preferably effected across a signal and data transmission route, indicated by a double arrow, without wires.

The transmitter and/or receiver devices 19, 20 are equipped with appropriate antenna systems, such as coils, dipoles or similar, for example, so that electro-magnetic waves can be received and/or transmitted in the appropriate frequency range. As standard in the prior art, these transmitter and/or receiver devices 19, 20 also incorporate appropriate amplifiers and/or modulation and demodulation circuits. These transmitter and/or receiver devices 19, 20 act as the HF modules of the binding electronics and may also be designed to operate with so-called Bluetooth technology through the electronic modules. In particular, Bluetooth modules used as transmitter and/or receiver devices 19, 20 can be easily integrated in the binding electronics and then operated within existing Bluetooth systems and Bluetooth applications.

In another possible embodiment, the evaluation device 13 and/or 14 may also have an interface 38 which can be connected using contacts via a line or wire connection to an appropriate external electronic unit 36. This interface 38 may be used as a means of updating software or loading so-called firmware updates in the evaluation devices 13 and 14 and/or for retrieving characteristic values and so-called history data recorded and stored in the evaluation devices 13, 14.

Apart from the preferred system of contactless data transmission by means of transmitter and/or receiver devices 19, 20, it would also be possible and within the scope of the invention to operate signal and data transmissions between the evaluation devices 13, 14 using wiring. Within the context of the invention, it would likewise be possible to provide only a single evaluation device 13 or 14 which detects states via sensors or sensor signals. In this case, the respective sensors 16 and 17 and/or 26 and 33 will be disposed permanently at the detection point, i.e. in the area of the toe and heel binding 4, 5. Another option is to provide a single evaluation device 13 or 14—in a known manner—in the region of the binding support plate.

The essential factor is that the electronic circuit arrangement 6 or binding electronics incorporate at least one electronic evaluation device 13 and/or 14 one software-driven programmable micro-controller 39, 40. This micro-controller 39, 40 is preferably a standard, freely programmable micro-computer, incorporating RISC-architecture, for example. A so-called "Ultra-Low-Power micro-controller" is used by preference, in order to keep power consumption as low as possible. In a known manner, such an evaluation device 13, 14 with a micro-controller 39, 40 may also incorporate appropriate clock generator circuits and optionally voltage control devices, interfaces for a software download, interfaces for wire communication and optical function controls such as LEDs and similar, for example.

The micro-controller 39, 40 also has at least one integrated, non-volatile memory system 41, 42 or the micro-controller 39, 40 connects via lines to at least one non-volatile memory system 41, 42. The important thing is that the micro-controller 39, 40 is programmed so that it can memorise settings detected by means of the sensor system 8 which can be manually edited and/or changing states of the safety ski binding 1 in the memory system 41, 42. The micro-controller 39, 40 is specifically configured to log settings and status data relevant to the system and safety as well of general interest. Above all, the states and settings detected by the sensor system 8 can be recorded and logged in the memory system 41, 42 so that they are available for processing and evaluation subsequently.

Preferably, at least the respectively set safety release value or Z-number of the toe and/or heel binding 4, 5 is stored in the memory system 41, 42 via the micro-controller 39, 40. Preferably, at least two settings values, i.e. a currently prevailing setting value and at least one previously valid setting value, can be stored in the memory system 41, 42. Naturally, it would also be possible for several, in particular five to ten, such last valid settings to be logged in the non-volatile memory system 41, 42.

In one advantageous embodiment, the memory system 41, 42 is set up to store an original safety release value entered by the manufacturer or dealer or service centre, which is determined by a specialist, detected or calculated. This memory region of the memory system 41, 42 can not be overwritten or erased by the micro-controller 39, 40 when subsequent changes are made to the safety release value by a general user of the safety ski binding 1 and this quasi original or specialist setting, which is preferably set up by an authorised specialist centre, will always remain available. Any changes or adjustments which may be made to the safety release value or Z number in the memory system 41, 42 via the micro-controller 39, 40 subsequently by a user will therefore be stored and recorded in other parts of the memory. Any change to the base value relating to the original setting applied by a specialist—if such a change can be made at all—is preferably only possible through an authorised service, e.g. a specialist centre or a service point.

The settings or changes and system states of the safety ski binding 1 detected by means of the sensors 26 and/or 33 are recorded in the non-volatile memory system 41, 42. This data buffer may incorporate at least one memory area for this purpose, preferably several regions of the memory.

Figure 2:
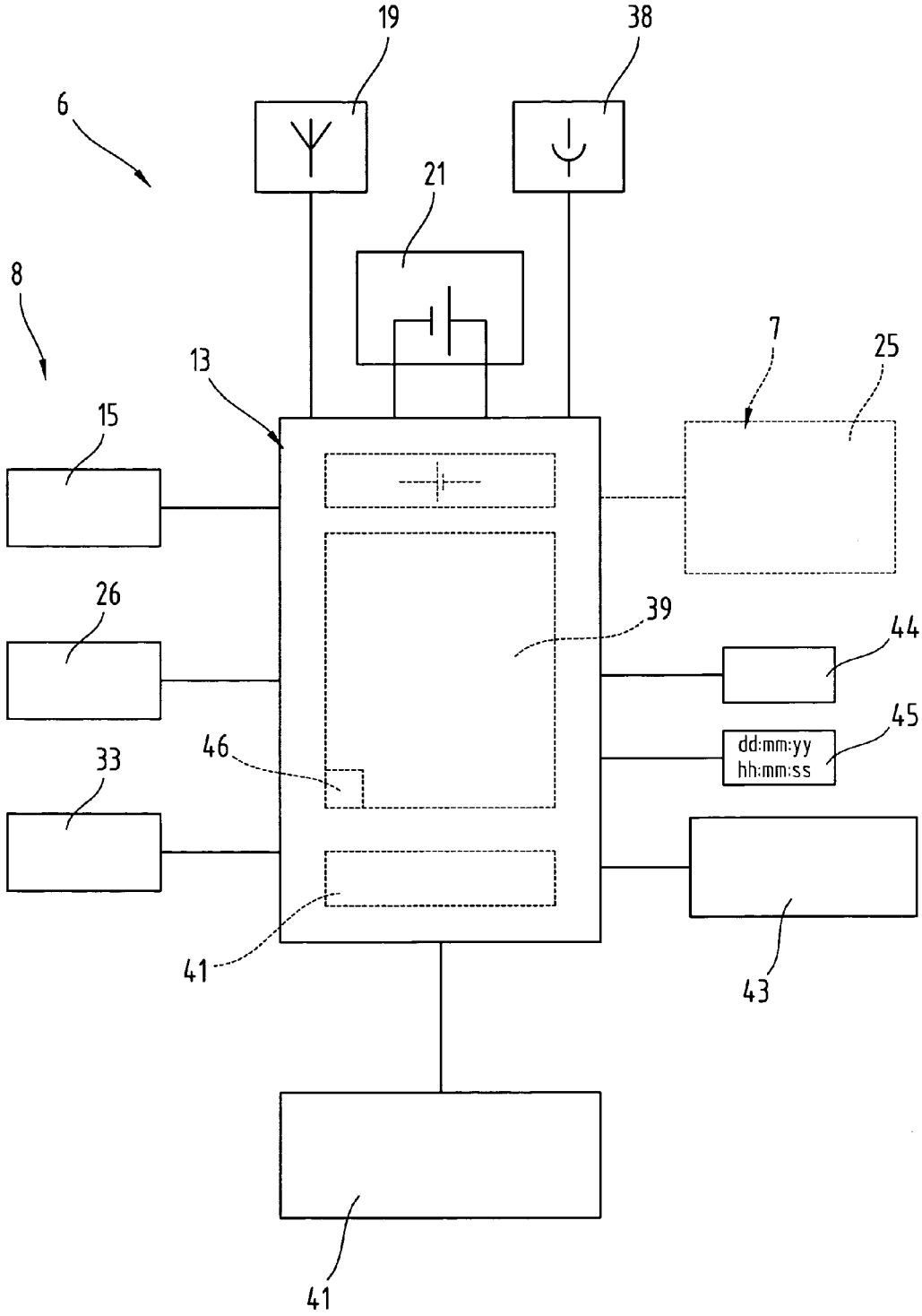
FIG. 2 is a simplified, schematic diagram showing a block diagram of one advantageous embodiment of the binding electronics used for a ski binding of the type illustrated in FIG. 1.

To provide a clearer understanding of the system, FIG. 2 is a schematic block diagram illustrating one possible advantageous embodiment of the circuit arrangement 6 or binding electronics.

The evaluation device 13, in particular its micro-controller 39, is connected to the sensor system 8—as described above—in particular to at least one of the sensors 15, 26, 33. The evaluation device 13 may also have a display device 7, as indicated by broken lines, which is preferably provided in the form of a LCD display. Alternatively or in combination with this, acoustic output devices may also be provided, for example summers, loudspeakers or similar.

In one advantageous embodiment, the evaluation device 13 and the micro-controller 39 may also co-operate with the wireless transmitter and/or receiver device 19. The evaluation device 13 preferably has a least one interface 38 with contacts, by means of which the evaluation device 13 is able to establish a connection in order to communicate with external computer units. Any software device which may be needed may be downloaded to the evaluation device 13 via this interface 38 and into the corresponding memory of the micro-controller 39. It would naturally also be conceivable to operate these functions wirelessly via the transmitter and/or receiver device 19.

A power supply system 21 is provided, preferably in the form of batteries or accumulators, in order to supply the electrical components of the circuit arrangement 6 with the power needed for operating purposes.

The internal and/or external memory system 41 is also illustrated, which keeps a permanent history or log of data relevant to safety, relevant to the system or of general interest, as well as the settings or other states of the safety ski binding. The evaluation device 13, in particular the micro-controller 39, also has at least one internal and/or external programme memory 43, in which the operating software or software programme to be processed is stored.

A central evaluation device, respectively the evaluation device 13 in the toe binding 4 and/or the evaluation device 14 of the heel binding 5, incorporates at least one permanent or non-volatile memory system 41 for storing at least an originally set or calculated safety release value. This memory system 41 is preferably also set up to record at least one currently prevailing or altered safety release value, which is detected electronically on an automatic basis by means of the sensor 15.

The non-volatile memory system 41 or 40 may be a so-called EEPROM memory or a flash memory. Memory systems 41 and 40 of this type can only be edited by special methods, in particular by programming methods and can be erased or altered by electrical or optical means only. The important thing is that the memory contents of the memory system 41 and 40 can not be readily erased, e.g. by interrupting or switching off the power or due to failure of the power supply system 21 and 20. Any attempt by a user to manipulate the stored and logged values will therefore not allow the memory contents to be deliberately reset and any such attempts at tampering will be foiled from the outset under certain circumstances.

The circuit arrangement 6 preferably also has a motion sensor 44, which is connected to the evaluation device 13 and the micro-controller 39. If two separate evaluation devices are provided, it is preferable to provide a separate motion sensor 44 for each of these electronic switch circuits. Such a motion sensor 44 will enable automatic switching between active full operation of the circuit arrangement 6 and an energy-saving mode or partially switched-off state of the circuit arrangement 6, all of which can be automated. If the micro-controller 39 registers no movements of the circuit arrangement 6 or ski binding for a specified period via the motion sensor 44, the binding electronics will automatically be switched to an energy-saving mode or partially switched-off state. For example, if a display device 7 is provided, it will be switched off and/or monitoring or scanning of the sensor system 8 will be halted and/or the micro-controller 39 will be switched to a "standby mode" operating on reduced power consumption. During such a "standby or sleep mode2 of the circuit arrangement 6 and micro-controller 39, only the signal states of the motion sensor 44 will be monitored and evaluated as a priority. As soon as the motion sensor 44 registers any activity or motion, the binding electronics or circuit arrangement 6 will be automatically switched back to an active mode, in which the evaluation device 13 will operate other functions.

In one advantageous embodiment, the circuit arrangement 6 or the evaluation device 13 also has an electronic date and/or time module 45, in particular a so-called real-time clock, by means of which states or status changes detected by the sensors can be logged in conjunction with the date and/or time. This will specifically enable the status values and changes registered and stored in the memory system 41 to be correlated to specific dates and times. As a result, it will be possible at a later point in time to ascertain the time and date when changes were made to the setting of the safety ski binding.

In one advantageous embodiment, the circuit arrangement 6 or the evaluation device 13 also has at least one counter 46, in particular a so-called timer, for measuring periods of time. This counter 46 may be used to detect the number of hours the circuit arrangement 6 has been active up to a certain time or to detect the number of days or hours for which the safety ski binding has been active. Depending on previous use or operating hours of the safety ski binding, detected electronically or by the software-driven counter, service recommendations for the safety ski binding 1 can be generated by the circuit arrangement 6. The user of the safety ski binding will preferably be alerted to such service recommendations via the display device 7, in particular by means of an appropriate message or a suitable graphic symbol.

In particular, this counter 46 in conjunction with the display device 7 is able to provide a service monitoring function and a service display in the safety ski binding 1. Likewise, by keeping count of the hours during which the circuit arrangement 6 or binding electronics has been active, a status display can be generated indicating the remaining life or remaining usage available from the power supply system 21. However, the power supply system 21 can also be monitored by periodically measuring the supply voltage and supply power of the power supply system 21.

In one advantageous embodiment of the circuit arrangement 6, this counter 46, which is preferably software-driven, may automatically intervene in the control sequences of the micro-controller 39 at specific intervals, e.g. on an annual basis or after approximately 20 days or active use or skiing.

Figure 3:
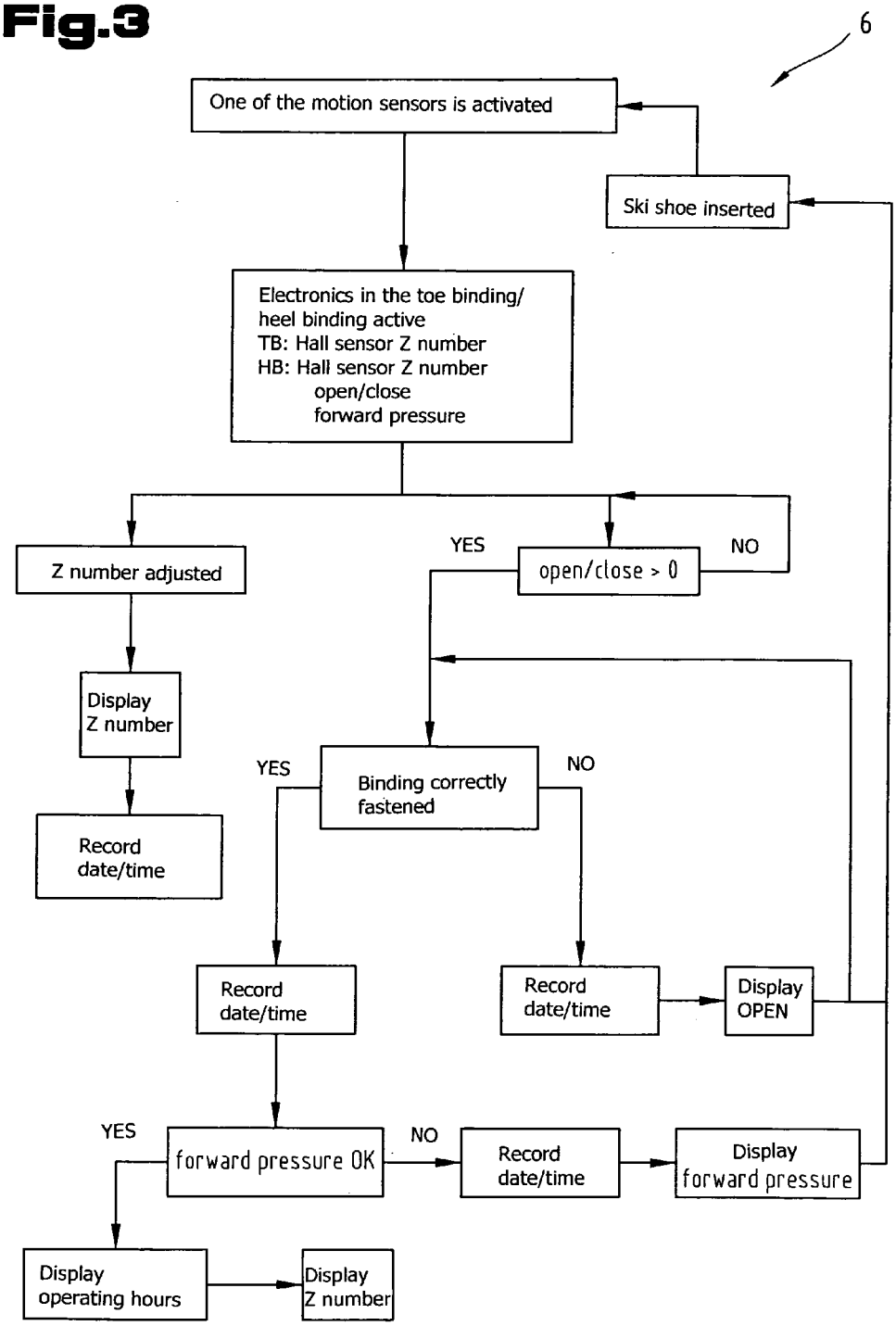
FIG. 3 is a schematic diagram setting out an example of a sequence used for various procedures operated in the binding electronics.

FIG. 3 provides a diagram illustrating the process sequence of an embodiment of the invention for the various procedures which take place in the circuit arrangement 6 or binding electronics. The description given below therefore also applies to the description given in connection with FIGS. 1, 2 above.

Starting from a non-operating state or "standby mode" of the binding electronics, at least one and preferably a plurality of sensors can be activated at any time. The evaluation device in the toe binding and in the heel binding are then active. Any adjustment or change made to the safety release value will then be monitored in the toe binding. Any intervention in the safety release values will likewise be continuously monitored in the heel binding. Furthermore, any change in the forward pressure can be monitored by means of the sensor system as well as the forward pressure prevailing at any one time determined, whilst the coupling state of the heel binding is continuously monitored.

If one of the safety release values is changed by the user of the safety ski binding, the safety release value which is currently valid or prevails, in particular the Z number setting, corresponding to the now valid standard, is displayed. The important thing is that this change is logged in the circuit arrangement 6 and the new or currently valid safety release value is permanently stored in the non-volatile memory system, i.e. this stored and logged value will remain permanently in the memory system, even if the electric power supply is interrupted, whether briefly or for a longer period. This enables any attempt by the user to manipulate or delete data to be effectively dealt with.

This log is preferably accompanied by references denoting the time at which the recorded change to the safety release value was made.

When the safety ski binding is closed, which may be at any unforeseeable time, this state can be detected via the sensor 33—FIG. 1—and is preferably logged in the memory system. In situations where the binding is not correctly fastened, this will like-wise by detected by the sensor 33—FIG. 1—e.g. an inadmissible intermediate position will preferably also be logged in the memory device. In addition, an appropriate message can be indicated, for example by an "Open" message on the display device 7—FIG. 1.

If, on the other hand, the binding is correctly fastened, the circuit arrangement 6 will then start to monitor the forward pressure of the slip-on spring system. If the forward pressure is not correct, for example if the forward pressure is too low or too high, this situation will be logged in the memory system. The fact that the forward pressure is too high or too low will preferably be displayed in an appropriate manner via the display device.

If the correct forward pressure is being applied to the ski shoe by the slip-on spring system, a display can then be given for a limited time indicating the number of operating hours or ski days to date and/or showing the Z number(s) and/or a ready message, such as "OK", at least temporarily.

Naturally, it would be conceivable to run a series of other procedures. For example, it would also be possible to provide a date and/or time display or show any other information on the display device 7—FIG. 1. For example, it would also be possible to display a logo of the binding or ski manufacturer or a type description on the display device 7—FIG. 1. Another option would be to use graphic animations on the display device 7—FIG. 1—in order to highlight or draw attention to the message.

For the sake of good order, it should finally be pointed out that in order to provide a clearer understanding of the structure of the safety ski binding or binding electronics, it and its constituent parts are illustrated to a certain extent out of proportion and/or on an enlarged scale and/or on a reduced scale and in a very schematic format.

The independent solutions proposed by the invention and the associated objectives may be found in the accompanying description.

Above all, the individual embodiments of the subject matter proposed by the invention illustrated in FIGS. 1; 2; 3 may be construed as independent solutions proposed by the invention. The associated objectives and solutions are explained in the detailed descriptions of these drawings.

What is claimed is:

1. Safety ski binding incorporating a toe and a heel binding and an electronic circuit arrangement, comprising a computer unit and a memory system as well as a sensor system for detecting at least one set safety release value of the safety ski binding, wherein the circuit arrangement has at least one electronic evaluation device and a software-driven, programmable micro-controller, the micro-controller comprising or being connected to a non-volatile memory system and being programmed to store manually altered settings of the safety release values detected by the sensor system, and the detected settings being logged in the non-volatile memory system.

2. Safety ski binding as claimed in claim 1, wherein a respective one of the electronic evaluation devices and sensor systems for detecting respective ones of the safety release values is provided in the toe binding and in the heel binding.

3. Safety ski binding as claimed in claim 2, comprising a separate power supply system for each evaluation device, and a transmitter and/or receiver device for operating a wireless, one-way or two-way data or signal transmission between them.

4. Safety ski binding as claimed in claim 1, wherein the evaluation device is wired to a display device for displaying the settings of the safety ski binding.

5. Safety ski binding as claimed in claim 2, wherein the evaluation devices have an electronic, non-volatile memory system for logging a prevailing set safety release value and at least one previously valid safety release value.

6. Safety ski binding as claimed in claim 1, wherein the evaluation device has an electronic date and/or time module for logging states or status changes detected by the sensor system correlated with date and/or time data.

7. Safety ski binding as claimed in claim 1, wherein the evaluation device has a counter for counting periods of time.

8. Safety ski binding as claimed in claim 1, wherein the sensor system has at least one sensor for determining or checking a forward pressure of a slip-on spring system of the heel binding relative to a ski shoe.

9. Safety ski binding as claimed in claim 1, wherein the sensor system has at least one sensor for detecting the open or closed state of the heel binding.

10. Safety ski binding as claimed in claim 1, wherein the evaluation device has at lest one interface for reading the detected settings logged in the non-volatile memory system.

11. Safety ski binding as claimed in claim 1, comprising a transmitter and/or receiver device programmed to read the detected settings logged in the non-volatile memory system.

12. Safety ski binding as claimed in claim 1, wherein the non-volatile memory system is a memory with stable memory contents and without a power supply.

13. Safety ski binding as claimed in claim 1, comprising a transmitter and/or receiver device or an interface with contacts designed to transmit data signals to an electronic computer unit and/or receive data signals from a peripheral, electronic computer unit, a handheld computer, a mobile telephone or any other mobile electronic unit.

14. Safety ski binding as claimed in claim 1, wherein the non-volatile memory system is an EEPROM memory or a flash memory.

* * * * *